US005378171A

United States Patent [19]

Czerlanis

[11] Patent Number: 5,378,171

[45] Date of Patent: Jan. 3, 1995

[54] ELECTRICAL CABLE CONNECTOR

[75] Inventor: John A. Czerlanis, Solon Mills, Ill.

[73] Assignee: Intermatic, Inc., Spring Grove, Ill.

[21] Appl. No.: 227,894

[22] Filed: Apr. 15, 1994

Related U.S. Application Data

[63] Continuation of Ser. No. 89,303, Jul. 9, 1993, abandoned.

[51] Int. Cl.[6] ..... H01R 4/24

[52] U.S. Cl. ..... 439/425; 439/444; 439/417

[58] Field of Search ..... 439/395–405, 439/417–419, 425, 426, 444

[56] References Cited

U.S. PATENT DOCUMENTS

| | | | |
|---|---|---|---|
| 3,115,541 | 12/1963 | Hanner et al. . | |
| 3,821,691 | 6/1974 | Reimer . | |
| 4,070,082 | 1/1978 | Werner . | |
| 4,283,104 | 8/1981 | Pemberton | 439/395 |
| 4,516,822 | 5/1985 | Wolfel . | |
| 4,648,674 | 3/1987 | Sanchez, Jr. | 439/395 |
| 4,749,367 | 6/1988 | Fraser . | |
| 4,793,824 | 12/1988 | Cozzens et al. . | |
| 4,861,278 | 8/1989 | McBride et al. | 439/395 |
| 4,921,439 | 5/1990 | Bofill et al. . | |
| 4,941,844 | 7/1990 | Bowden et al. . | |

*Primary Examiner*—David L. Pirlot
*Attorney, Agent, or Firm*—McCaleb, Lucas & Brugman

[57] ABSTRACT

A connector assembly for effecting electrical circuit connection between insulated wires without removing the insulation therefrom including two identical insulated unitary housing members capable of being coaxially interfitted to define a central passage chamber for a dual conductor cable; each housing member carrying a plate terminal formed with an elongated central opening receptive of a single wire conductor and having a sharp prong protruding from one side thereof for penetrating the insulation of the cable and contacting one wire conductor thereof when the housing members are interfitted; each of the plate terminals operating to penetrate the insulation of an associated single wire conductor to establish circuit connection therewith.

8 Claims, 2 Drawing Sheets

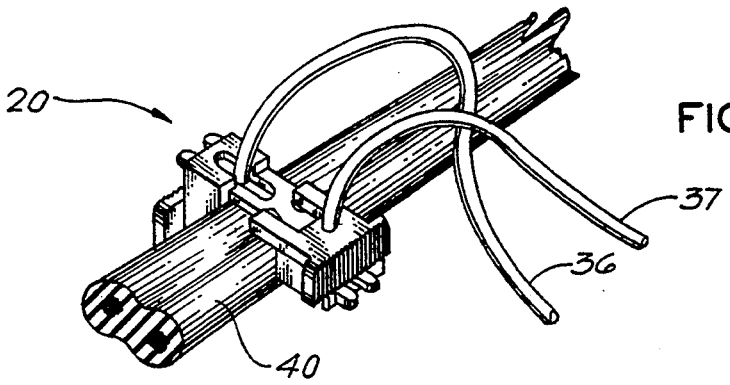
FIG. 1
FIG. 2
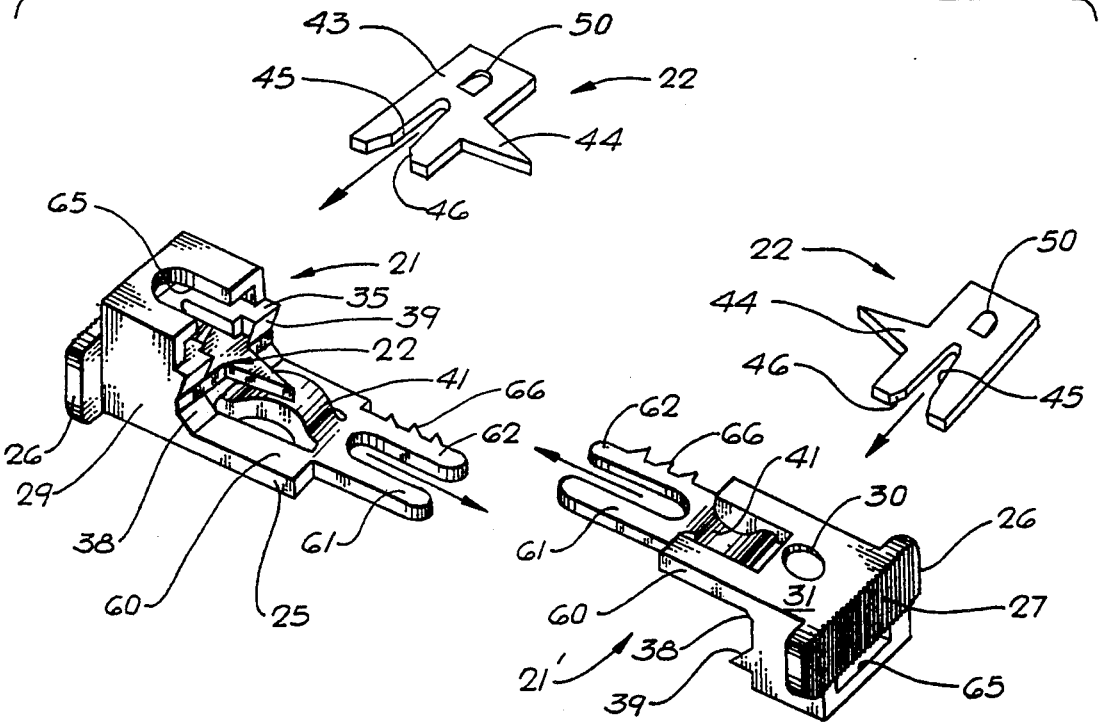

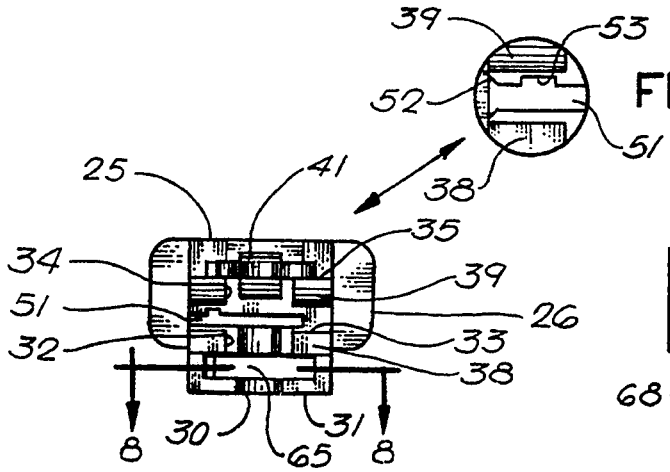
FIG. 3A
FIG. 3
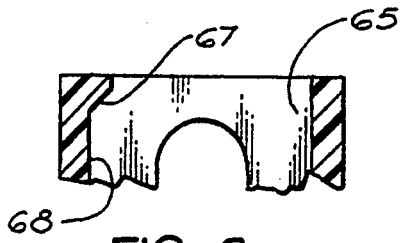
FIG. 8
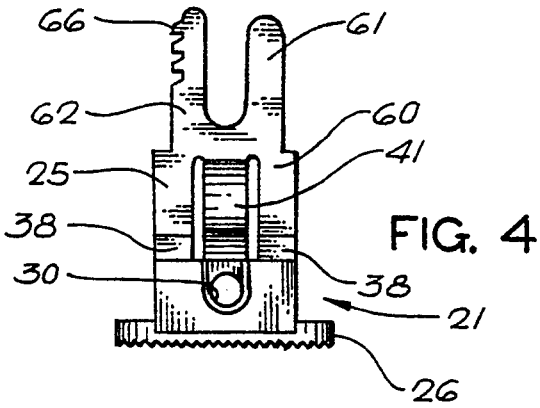
FIG. 4
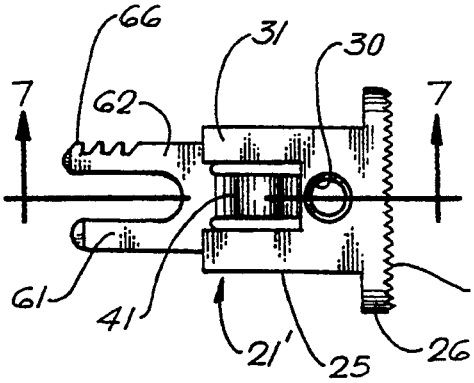
FIG. 5
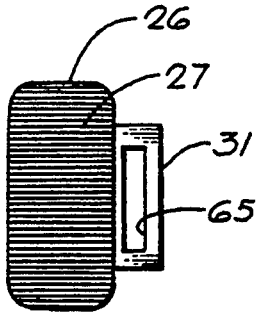
FIG. 6
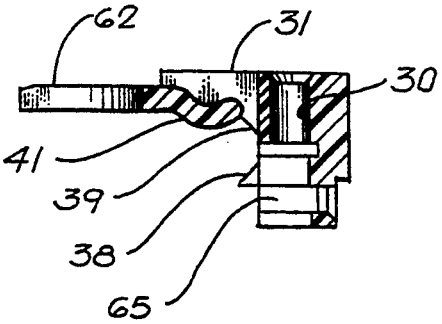
FIG. 7

ELECTRICAL CABLE CONNECTOR

This is a continuation of copending application Ser. No. 08/089/303 filed on Jul. 9, 1993 abandoned.

This invention concerns electrical wiring connectors and more particularly to a connector assembly for establishing circuit connection between insulated wire conductors without removing the insulation therefrom.

The prior art is replete with electrical connectors in which prongs or pins penetrate the insulation of electrical conductors to establish circuit connection therewith; as evidenced, for example, by U.S. Pat. No. 3,115,541 issued Dec. 24, 1963. Such prior connectors have been relatively restricted in their application, however, to insulated conductors of a specific or narrowly limited variation in conductor to conductor center line or outside dimension in order to insure that the penetrating prongs or pins establish contact with the wire conductors.

Additional shortcomings encountered with previously developed connectors are found in their complexity of structure and design leading to difficulties of production, installation and operational dependability. In many instances, once installed, previous connectors cannot be detached from the conductors thereby necessitating complete replacement of the conductors, the connectors and in some instance the appliances attached thereto. Other connectors of the prior art are similarly difficult to repair; particularly by the do-it-yourself consumer.

This invention is directed to an improved, simplified electrical connector assembly which overcomes the aforenoted shortcomings of the prior and has the operational capability of electrically coupling two or more insulated wire conductors.

BRIEF DESCRIPTION OF INVENTION

In brief this invention comprises a pair of unitary, identical housing members of dielectric material, which are adapted to be coaxially interfitted and moved to selected axial positions over an intervening single or multiple wire insulated cable so that the major axis of the interfitted housing members lies substantially at right angles to the lengthwise axis of the cable. The housing members carry electrically conductive terminals having projecting prong contacts which are in co-planar opposing alignment and are operable in response to lateral movement of the housing members toward one another, to penetrate and contact insulated conductors of the cable. Yieldable spring members cooperative with each housing member operatively engage the cable to guide and center the same between the housing members such that the co-planar prong contacts are aligned with the wire conductors thereof. Locking means serves to detachably interlock the two housing members in selected positions of axial adjustment whereby to firmly embrace the cable therebetween. Each housing member is receptive of an insulated branch circuit conductor that traverses the associated terminal, passing through a central slot of the terminal which is open at one end and serves to penetrate the insulated cover of the branch conductor to establish circuit making contact therewith in response to movement of the terminal into its housing.

It is an important object of this invention to provide an improved electrical connector assembly having a minimum of parts which is easily and quickly installed to interconnect two or more insulated electrical conductors.

Another important object of this invention is to provide an improved connector assembly, as in the preceding object, that is operational to electrically couple two or more insulated conductors without removing the insulation therefrom.

Still another important object of this invention is to provide an improved electrical connector assembly having two identical insulated housing parts that are coaxially interfitted to extend transversely of the lengthwise axis of an insulated conductor cable embraced therebetween.

Another object of this invention is to provide an electrical connector for use with multiple conductor insulated cables in which identical reversely oriented housing parts are coaxially interfittable to embrace the cable therebetween; the housing parts having co-planar electrically conductive terminals, each capable of penetrating the cable insulation to establish contact with a single conductor thereof.

Still another object of this invention is to provide a simplified electrical connector having a two part housing, each having terminal means establishing circuit making contact with a single insulated electrical conductor by penetrating the insulation thereof.

A further object of this invention is to provide an electrical connector as set out in the immediately preceding object in which the two housing parts are coaxially interfittable to embrace a multiple conductor insulated cable therebetween and in which the said terminal means of each housing part includes a prong for penetrating the insulation of the cable to establish contact with one of the conductors thereof.

Still a further object of this invention is to provide an electrical connector assembly comprising two identical housing parts which are coaxially interfittable and include resilient locking means for detachably securing the housing parts together in selected axial positions.

Having described this invention, the above and further objects, features and advantages of this invention will appear from the following detailed description of a preferred embodiment thereof illustrated in the accompanying drawings and representing the best mode presently contemplated for enabling those of skill in the art to practice this invention.

IN THE DRAWINGS:

FIG. 1 s a perspective view of a connector assembly of this invention assembled with a dual-wire cable and two branch single wire conductors;

FIG. 2 is an exploded perspective view of the housing and terminal members embodied in the assembled connector illustrated in FIG. 1;

FIG. 3 is a front elevation view of the right hand housing member shown in FIG. 2;

FIG. 3A is an enlarged detail view of a terminal locking detent seen in FIG. 3;

FIG. 4 is a top plan view of the left hand housing member shown in FIG. 2;

FIG. 5 is a bottom plan view of the housing member shown in FIG. 3;

FIG. 6 is a rear elevational view of the housing member shown in FIGS. 3 and 5;

FIG. 7 is a cross-sectional view taken along vantage line 7—7 of FIG. 5, looking in the direction of the arrows therein; and FIG. 8 is an enlarged partial cross sectional view taken along vantage line 8—8 of FIG. 3, and looking in the direction of the arrows therein.

DESCRIPTION OF THE PREFERRED EMBODIMENT

Turning now to the features of the illustrated preferred embodiment of this invention, the same is directed to its installation on a flat, dual wire conductor, cable for the purpose of establishing branch circuits coupled to so called ground lights familiarly employed to illuminate garden walks and the like. Other uses of this invention, however, will readily occur to those skilled in the art.

As shown in FIGS. 1 and 2, the connector assembly 20 of this invention comprises two identical reversely oriented housing members 21, 21' (seen individually in FIG. 2) preferably molded of a suitable dielectric material, such as polycarbonate plastic or its equivalent. Each member 21, 21' carries a brass or other electrically conductive terminal, designated generally at 22, which will be described more fully hereinafter.

Inasmuch as the housing members 21, 21 are identical, a detailed description of one will suffice for both, with corresponding parts thereof being commonly numbered.

Thus with special reference to FIG. 2 and the detail FIGS. 3–8, the features of the housing members will follow.

As illustrated in FIG. 2, each housing member comprises a main body of generally overall L-shaped configuration comprising a cube shaped base portion 24 having an extending leg portion 25 projecting outwardly at a right angle from one operationally inner end of base portion 24. The opposite end of portion 24 is distinguished by a transversely aligned and laterally outwardly protruding manually engageable portion 26 having a grooved or serrated outer face 27 to provide a non-slip surface thereon (see FIGS. 2 and 6).

From FIGS. 2 and 3, it will be understood that base portion 24 is formed with a through passageway 30 extending inwardly of the bottom side 31 of the base portion, through a U-shaped opening 32 extending inwardly of a leading edge of an interior planar partition wall 33 of the base portion and a second U-shaped opening 34 formed in a second partition wall 35 parallel to partition 33. It is to be noted that the U-shaped openings are registeringly superposed and have their semi-circular inner ends coaxially aligned to form semi-cylindrical portions of passageway 30.

Such passageway is readily adopted to receive a single insulated electrical conductor, such as branch circuit conductors 36 and 37 as shown in FIG. 1.

It is to be noted that the leading or outer ends of the partition walls 33 and 35 have intersectingly aligned, angularly disposed faces 38 and 39, respectively. These end faces, when the opposing housing members 21, 21' are interfittingly assembled as seen in FIG. 1, form the side walls of a passage through which cable 40 passes. The angulated dispositions of these end faces assist in aligning and maintaining the cable centrally between the leg portions 25 of the two interfitted housing members, as will be explained presently (see FIGS. 2, 3, 4 and 7).

In addition to the above referred to end faces 38 and 39, it will be noted that each of the extending leg portions 25, has an integral cantilever spring portion 41 at its base end where it joins the base portion 24 of its associated housing member (see FIGS. 4 and 7). Such spring portions extend outwardly to one side of the formational plane of the leg portions as shown in FIG. 8, to invade the chamber passage defined between the two assembled housing members. Thus when the housing members are assembled about cable 40 as set out in FIG. 1, the spring portions 41 cooperate with the above described end faces 38 and 39 to align and maintain cable 40 centrally between the housing members and more particularly centrally aligned with and between the co-planar terminals 22 for a wide variety and range of sizes and thicknesses.

As best shown in FIG. 2, the connector assembly 20 comprises two generally planar metal plate terminals 22, one of which is mounted in each of the housing members 21, 21'. It will be noted that each terminal comprises a generally rectangular shaped body 43 having a sharp triangular shaped prong 44 protruding from one elongated side thereof. Formed inwardly of one end of the body 43 is an elongated slot or opening 45 having a widened mouth at its outer open end, indicated at 46. The long sides of the opening 45 preferably are suitably coined to provide cutting edges therealong and a detent finger 50 is struck outwardly of one face of the terminal body 43 for purposes of locking the terminal to its associated housing, as will be described presently.

With reference to FIGS. 2, 3 and 7 it will be recognized that each housing member also includes a rectangular shaped, interior chamber 51 opening inwardly of one side of body portion 24 thereof for slidably receiving a terminal member 22 (see FIG. 3A). The upper wall of this chamber adjacent its entrance end 52 has a detent opening or recess 53 which receives the upstanding detent finger 50 of a terminal 22. Thus when a terminal 22 is inserted into its rather close fitting chamber 51 so that the prong 44 thereof extends parallel to and partially over leg portion 25 of an associate housing member, the open throated slot thereof 45 will encounter an insulated conductor 36 or 37 present in passageway 30. Continued insertion movement of the terminal causes the sharp sides of slotted opening 45 to penetrate and cut through the conductor's insulation establishing circuit making contact therewith. When the terminal is fully inserted into its chamber 51 the detent 50 and recess 53 lock together to hold the terminal in place.

Turning now to the leg portion 25 of each housing member, reference is made to FIGS. 2, 5 and 7 of the drawings whereat the features thereof are illustrated.

As shown, the leg portion 25 of each housing member extends integrally outwardly of one inward side of the housing's body portion 24 and includes a planar platform section 60 from which extend two laterally separated parallel arm portions 61 and 62. The spacing between these arm portions is such as to accommodate the free passage thereof past a conductor 36 or 37 locked to the housing member by the terminal 22 as previously explained. The outer ends of these arm portions are suitably radiused to avoid interference with the sides of a laterally extending chamber 65 which passes through the housings body portion 24 immediately beneath the interior partition 38 thereof (see FIGS. 3 and 8). The width of this chamber is designed to accommodate passage of the two arm portions 61, 62 therethrough. In this respect it will be noted that arm portion 62 is formed with a plurality of serrated teeth 66 along its laterally outer edge which are designed to engage and lock with a pawl protrusion 67 formed on one wall 68 of the chamber 65 as best shown in FIG. 8.

Since the plastic of the molded housing members is somewhat resilient interfitting the housing members by inserting the arms 61, 62 into the opposing chambers 65 of the two housing members causes arms 62 to flex over the projecting pawls 67 and lock the teeth 66 therebehind, thus securing the housing members in selected coaxial positions snugly over and about the cable 40 in the manner illustrated in FIG. 1. In this regard it will be noted that the two identical housing members are aligned in reverse orientation (i.e., member 21' being bottom side up) prior to being interfitted as above set forth. It further is to be noted that once the housing members are mounted and locked over the cable 40, if it is desired to remove the connector 20, such may be readily accomplished by simultaneously depressing the arms away from pawls 67 following which the housing members may be pulled apart.

It further is to be noted that as the housing members are pushed toward one another by means of the finger engaging portions 26, the terminal prongs 44 laterally penetrate the cable insulation, from opposite sides thereof. Note that the springs 41, serve to engage the cable and orient the same in the cable receiving chamber formed between the two housing members in conjunction with the angulated surfaces 38, 39 so that the cable conductors are in the plane of the opposing prongs 44. Thus when insulation penetration of the prongs is sufficient, circuit connection is established between the cable wires and each of the branch conductors 36, 37 engaged by terminals 22. Due to this lateral cable penetration different conductor center distances of parallel wire conductors for different size cables is no longer a concern.

It is particularly noteworthy to recognize that the connector assembly of this invention is useful with both insulated flat and round style cables and that cables of various sizes readily may be used therewith. Thus the need for custom size cable is eliminated with the connector assembly hereof which readily accommodates 18 gauge to 12 gauge insulated flat or round style cable, by way of example.

Of added importance is the fact that the connector assembly hereof is easily assembled and disassembled, making repairs and re-use of the connectors most convenient, particularly by the do-it-yourselfer.

From the foregoing it is believed that those skilled in the art will readily recognize and appreciate the novel advancement over the prior art afforded by this invention and will understand that while the same has hereinabove been described in relation to a preferred embodiment shown in the drawings, such is susceptible to modification, variation and substitution of equivalents without departing from the scope of this invention which is intended to be unlimited except as appears on the following appended claims.

The embodiments of the invention in which an exclusive property or privilege is claimed are defined as follows:

1. A connector assembly for electrically connecting insulated dual conductor cables of various outside dimensions with two insulated single electrical conductors, comprising:

two identical unitary, generally elongated dielectric housing members, each comprising a cube-like base having a pair of laterally spaced co-planar arms extending at right angles from one side thereof;

said base having an internal chamber extending inwardly of said one side at a level parallel to said arms, an electrically conductive terminal member having a planar body formed with a sharp prong projecting outwardly of one side thereof and an elongated slot opening inwardly of one end thereof;

said base having means for slidably receiving said terminal member so that said prong thereof extends outwardly of said one side parallel to said arms and chamber;

said housing members being coaxially interfitted in assembly, with said arms of one housing member insertable into said chamber of the other housing member and vice versa, whereby to provide a central opening between said members for the introduction and passage of insulated dual conductor cable; the assembled connector lying transverse to the longitudinal axis of said cable whereby movement of said interfitted housing members toward one another causes each of the prongs carried thereby to laterally penetrate the cable's insulation and contact an individual conductor therewithin.

2. The combination of claim 1, and cooperating detent means on said terminal member and said base, for locking said terminal member in operation position.

3. The combination of claim 1, wherein one of said arms of each housing member has a plurality of serrated teeth along one edge thereof and each said chamber has a pawl projection interferingly engageable with said teeth; each said one of said arms being sufficiently flexible to override a said pawl and effect interlocking engagement of a selected one of said teeth therewith to thereby position said housing members in selected axial positions over said cable.

4. The combination of claim 1, wherein said central opening between the interfitted housing members is variable in size to accommodate cables of various outside dimensions and distances between conductor center lines.

5. The combination of claim 1, and wherein each said base has a passageway for the introduction and passage of an insulated single electrical conductor, the said slot in said terminal receiving said insulated conductor and passing thereover to penetrate the insulation thereof and make contact with the single electrical conductor in response to sliding movement of said terminal into said base.

6. The combination of claim 1, wherein said housing members are molded of polycarbonate plastic.

7. The combination of claim 1, and means for positioning said cable centrally of said cable passage opening formed by said interfitted housing members.

8. The combination of claim 7, wherein said means for positioning said cable includes spring means of each housing member for resiliently engaging the exterior of cables of different exterior dimensions.

* * * * *